United States Patent [19]

Bergh

[11] 4,020,596

[45] May 3, 1977

[54] CONVERTIBLE BLAST CLEANING UNIT

[75] Inventor: John C. Bergh, Elkhart, Ind.

[73] Assignee: Wheelabrator-Frye, Inc., Mishawaka, Ind.

[22] Filed: Dec. 19, 1975

[21] Appl. No.: 642,590

Related U.S. Application Data

[63] Continuation of Ser. No. 522,464, Nov. 11, 1974, abandoned.

[52] U.S. Cl. ..... 51/9 M; 51/180; 51/8 SR

[51] Int. Cl.[2] ..... B24C 9/00

[58] Field of Search ..... 51/8 R, 8 SR, 9 R, 9 M, 51/180

[56] References Cited

UNITED STATES PATENTS

| | | | |
|---|---|---|---|
| 1,342,488 | 6/1920 | Woods | 51/180 X |
| 2,238,757 | 4/1941 | Stevason | 51/180 X |
| 3,262,228 | 7/1966 | Schenck | 51/9 M |
| 3,566,543 | 3/1971 | Fogle | 51/9 M |
| 3,827,188 | 8/1974 | Fuma | 51/9 M X |
| 3,906,673 | 9/1975 | Goto | 51/9 M |
| 3,934,372 | 1/1976 | Diehn | 51/9 M X |

FOREIGN PATENTS OR APPLICATIONS

| | | | |
|---|---|---|---|
| 160,839 | 2/1954 | Australia | 51/8 R |

*Primary Examiner*—Gary L. Smith
*Attorney, Agent, or Firm*—McDougall, Hersh & Scott

[57] ABSTRACT

This invention relates to a portable blast cleaning unit employing one or more airless centrifugal blasting wheels for throwing particulate against a surface to be treated. By use of separate modules, the cleaning unit can be adapted for side cleaning of vertically disposed surfaces or upblast cleaning of horizontal surfaces. The cleaning unit includes means for effecting a sealing relation with the surface to be treated and for recovering and air washing the blast media to remove the debris generated by the blasting process. The air wash separating means is contained directly in the blasting head so that a completely portable and self-contained unit capable of recycling the particulate is obtained.

9 Claims, 4 Drawing Figures

32
30
44
AIR AND
DEBRIS
34
10
42
36
37
38
31
40
28
30
45
26
24
12
16
20
18

CONVERTIBLE BLAST CLEANING UNIT

This is a continuation of application Ser. No. 522,464 filed Nov. 11, 1974 now abandoned.

BACKGROUND OF THE INVENTION

This invention relates to portable blast cleaning devices. More particularly, it relates to a device of the type which utilizes one or more airless centrifugal blasting wheels for throwing particulate, such as steel shot, steel grit or other abrasives against a surface. Such devices are particularly adapted for cleaning large surfaces as, for example, the outside hull of a ship. The abrasive blasting process is effective for removing scales, paint chips, rust and miscellaneous debris, thereby restoring the surface in preparation for subsequent refinishing.

In previous blast heads of the type disclosed herein, it was not feasible to utilize one device to treat surfaces having different spatial orientations. For example, a ship's hull has vertically disposed portions as well as horizontal sections. Thus, a device designed to operate as an upblast cleaner could treat the horizontally disposed surfaces while a separate side blast cleaner was necessary to treat vertically disposed surfaces. Examples of these prior art devices are: U.S. Pat. No. 3,566,543 to Fogle (side blast); U.S. Pat. No. 3,788,010 to Goff (side blast); U.S. Pat. No. 3,034,262 to Paulson (side blast); copending U.S. application Ser. No. 443,389 to Diehn now U.S. Pat. No. 3,900,969 (side blast) and copending U.S. application Ser. No. 513,633 now U.S. Pat. No. 3,934,372 (upblast).

In a typical blast cleaning device, whether upblast or side blast, the device operates in sealing engagement with the surface to be treated as by a flexible seal disposed around the blast area. Usually, the seal is maintained in contact with the surface by various movable frame arrangements well known in the art. After striking the surface, the blasting particulate is reclaimed and reused in the device in order to effect economical operation.

In many of the existing devices, there exists a problem in recycling the particulate due to the contamination and buildup of foreign particles in the device. As buildup occurs, this debris from the blasting operation mixes with the abrasive and is recycled through the device, reducing its effectiveness and tending to clog or otherwise impair efficiency.

Another problem commonly experienced in devices of this type is heat buildup in the blasting area due to the dissipation of kinetic energy of the particulate against the surface being treated. A unique solution to both of these problems is the use of an air wash separator in the portable blasting head as disclosed in copending application Ser. No. 513,633. Such a design is incorporated into the present invention. The air wash separator is effective for separating material according to density, thereby permitting the heavier abrasive to pass downwardly into a recycling hopper while the lighter debris is blown out of the device. The air wash also effects cooling of the device to reduce heat buildup.

Perhaps the most serious drawback of such devices, however, is the lack of versatility due to the specialized design which each requires in order to perform efficiently. Thus, the side cleaners are incapable of performing their operation when used on a horizontally disposed surface such as the underside of a ship's hull. for example, the Paulson device operates on a gravity rebound principal, and when that device is rotated 90° from its correct operating position, it will no longer function properly.

It is accordingly an object of the present invention to provide an abrasive cleaning device which recycles spent abrasive for reuse.

It is another object of the present invention to provide a portable blast cleaning head which prevents buildup of foreign matter in the returned abrasive to prevent gumming and sticking of the apparatus.

It is another object of the present invention to provide an air flow in the blast area of the device to prevent a heat buildup.

It is a further object of the present invention to provide directly in the blast head a compact and efficient means of air wash separating debris and foreign material from the abrasive.

It is another object of the present invention to provide a portable blast cleaning unit which is capable of cleaning both horizontally and vertically disposed surfaces.

It is a further object of the present invention to provide a portable blast cleaning unit which is in modular form, so that by substituting one module for another, the device is adapted to clean vertical and horizontally disposed surfaces.

Other objects and advantages of the invention will be apparent from the concluding portion of the specification.

DETAILED DESCRIPTION

Figure 1:
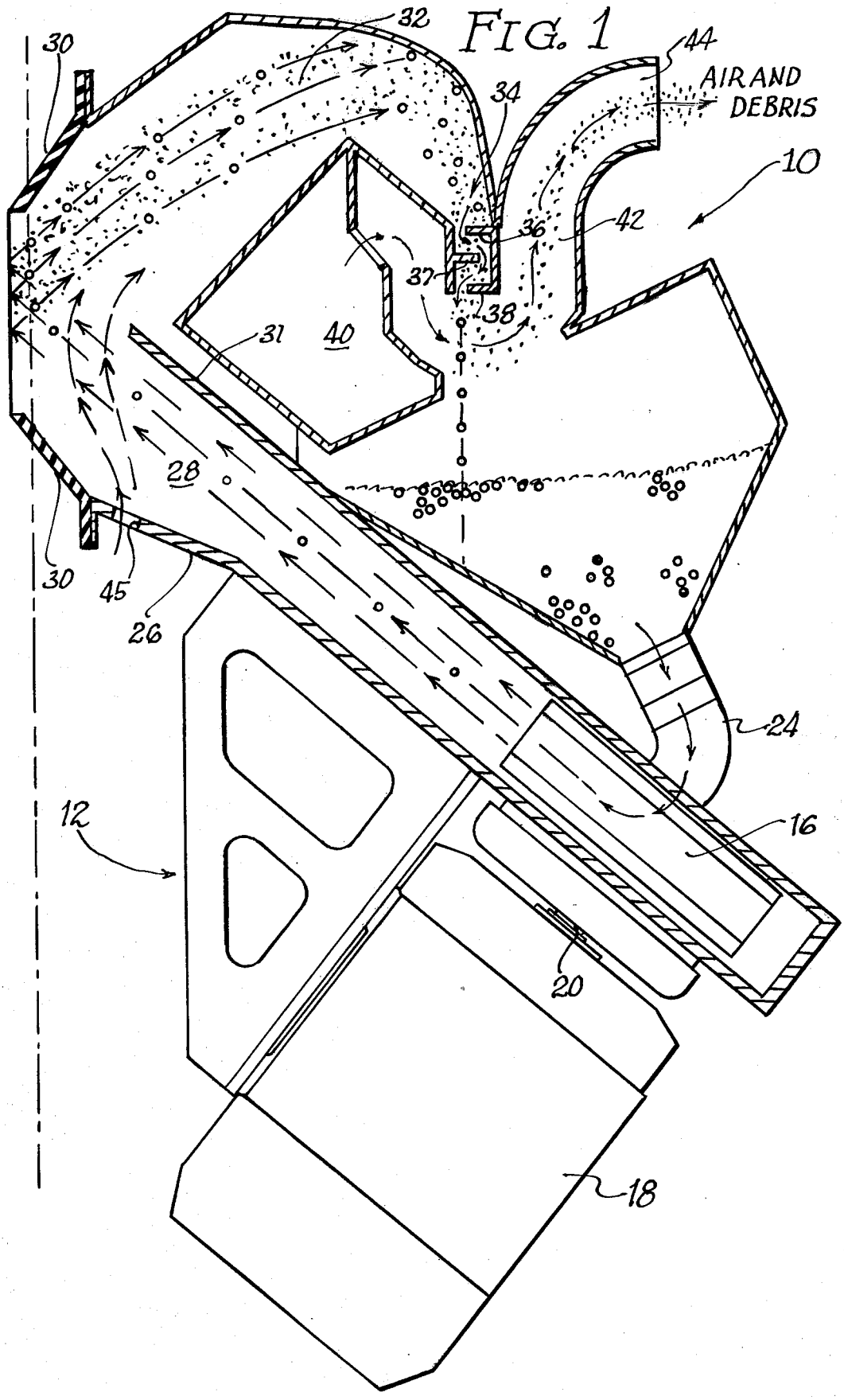
FIG. 1 is a cross-sectional view of the blast cleaning unit with the side blast module installed on the blasting head.
Figure 2:
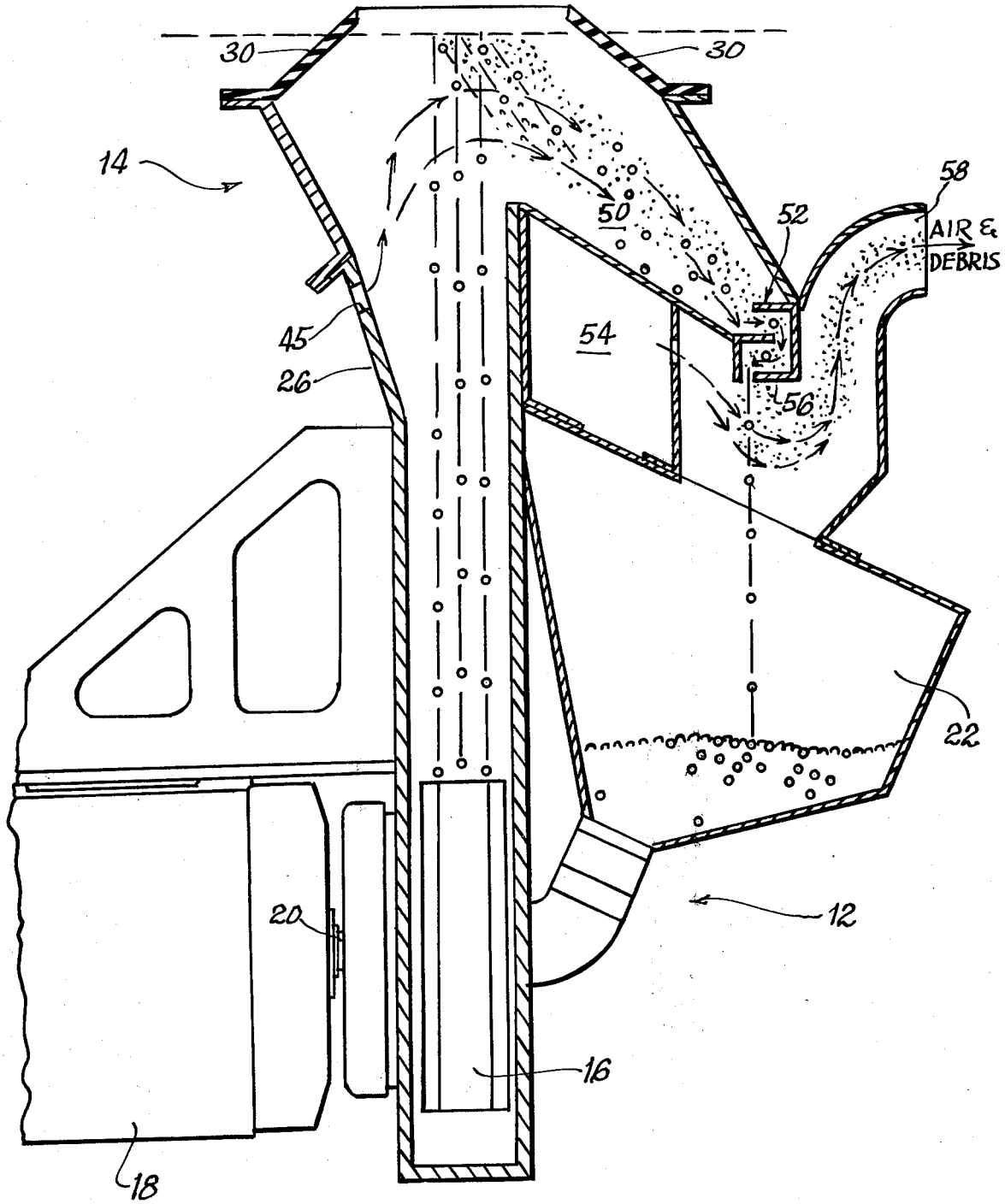
FIG. 2 is a cross-sectional view of the blast cleaning unit with the upblast module installed on the blasting head.

Referring to FIGS. 1 and 2, the convertible blast cleaning unit is illustrated. In the FIG. 1 illustration, it has a side cleaning module 10 attached to the blasting head structure 12. In the FIG. 2 illustration, the upblast module 14 is attached to the blasting head structure 12. As will be appreciated, the identical blasting head structure 12 is adapted to receive either of the two modules 10 or 14 depending upon the particular application. The blast cleaning head 12 comprises the basic cleaning structure of the device while the modules 10 and 14 contain a rebound corridor and air wash separator effective for cleaning and recycling abrasive to the blasting head for reuse.

The blasting head 12 comprises at least one and preferably two abrasive throwing wheels 16. These wheels are known in the art and are preferably airless centrifugal blasting wheels of the type manufactured by Wheelabrator-Frye Inc. of Mishawaka, Indiana. Each wheel is powered by a motor 18 coupled by means of a direct drive shaft 20. These wheels are rotated at high angular velocities effective for propelling abrasive particles outwardly therefrom. The abrasive is supplied to the center of the wheel from a hopper 22 via a connecting pipe 24 which may have a flow control valve thereon. The wheel functions to throw the abrasive at high velocities away from its center. Thus, in the construction illustrated, the housing 26 forms a blast corridor 28 so that the abrasive thrown from the wheel is focused up the corridor 28 where it impinges upon a surface to be treated.

Closing off the surface under treatment is a compliant seal 30 preferably formed of a polyurethane material. In order to insure maximum recycling of abrasive and protect workers, the seal is maintained in intimate contact with the surface to prevent loss of abrasive. Abrasive thrown from the wheel 16 travels up the blast corridor 28 where it impinges upon the surface under treatment. Most of the abrasive and debris rebound after striking the surface into a rebound corridor 32. Abrasive which lacks sufficient kinetic energy to pass through the rebound corridor is collected on the wall 31 where it slides back to the hopper 22. The rebound corridor 32 forms a first section of the side blast module 10. The rebounding particulate and the debris pass through the rebound corridor 32 where they begin a gravitationally forced drop into a labyrinth 34, also part of the side blast module.

The labyrinth 34 comprises a set of three spatially adjustable ledges 36–38. These ledges are adjusted so as to insure that the particulate and debris come substantially to rest as they pass through the labyrinth and therefore emerge therefrom in a state of gravity free fall with no other component of kinetic energy. The distance between the various ledges 36–38 can be adjusted as necessary for a particular application to insure that the gravity free fall from the ledge 38 is obtained.

The gravity free fall from ledge 38 is a necessary element of the invention in order to insure an effective air wash separation of the abrasive from the debris which is commingled therewith. As the mixture of abrasive and debris drops from the ledge 38, it thereby forms an even curtain of falling material. Air is drawn across this curtain through an air inlet plenum 40 and across the falling curtain of abrasive and debris. The abrasive being substantially denser than the debris, it is relatively unaffected by the air wash and therefore drops downwardly into the hopper 22 for reuse. The lighter debris, such as paint chips, rust and various small particles, however, are readily diverted from the downward direction by the air flow across the material curtain. Most of this debris will become entrained upon the airstream and be carried up through an exhaust plenum 42 and out exhaust port 44 under the action of a suction fan (not shown) connected to the exhaust port 44. The labyrinth 34 and the air wash separator just described are discussed in greater detail in copending application Ser. No. 513,633assigned to the present assignee and hereby incorporated by reference.

In order to prevent heat buildup in the blast area due to the dissipation of the kinetic energy of the abrasive striking the surface, it is desirable to draw air thereacross. This is accomplished by providing a small air inlet 45 in the housing 26. Air is drawn in under force of the above-mentioned suction fan, across the blast area, through the rebound corridor 32 and labyrinth 34. it is there exhausted with the air wash through exhaust 44.

Figure 3:
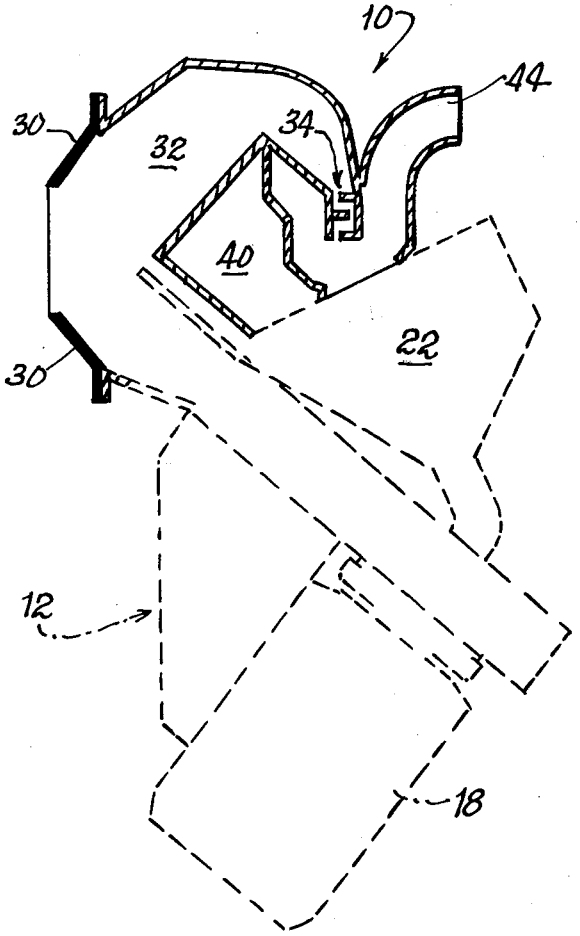
FIG. 3 is a view similar to FIG. 1 showing the blasting head in phantom, thereby to highlight the details of the side blast module.

In order to convert the side blast illustrated in FIG. 1 to the upblast illustrated in FIG. 2, it is necessary to remove the module 10 which is composed of rebound corridor 32, air plenum 40, labyrinth 34 and exhaust plenum 42. As indicated in FIG. 3, this entire construction is fabricated as a single assembly. In order to remove it, the device is shut down and flexible seal 30 is removed. The module 10 is then unbolted from the blast head 12 and replaced with the module 14 illustrated in FIGS. 2 and 4. Module 14 converts the same blast head 12 into an upblast cleaner.

Referring now to FIG. 2, it will be seen that when used as an upblast cleaner with module 14, the blast housing 12 is aligned so that the wheel throws the abrasive substantially straight up against a horizontally disposed surface. The seal 30, removed during disassembly of module 10 is placed over the opening of the module 14 to again form a compliant seal around the blast area.

Operation of the FIG. 2 device is similar to that described for FIG. 1. The abrasive and debris removed from the treating process passes into a slightly modified rebound corridor 50 where it enters a labyrinth 52. The entry of abrasive and debris into the rebound corridor is enhanced by the flow of air across the blast area from inlet 45. This air flow also reduces the temperature in the blast area to prevent heat buildup.

Air for the wash enters through a plenum 54 to air wash the falling abrasive and debris as they fall from the lower ledge 56 of the labyrinth 52. The abrasive returns to the abrasive supply hopper 22 while the air with the debris entrained thereon passes out of an exhaust opening 58 under force of the suction fan.

As has been described, a motor and blast wheel, or aternatively a pair of motors and blast wheels are provided in a housing 26 with an abrasive supply hopper 22 connected to the throwing wheels. Adapted to fit over the upper portion of the housing are a pair of modules 10 and 14 which adapt the throwing unit for either side cleaning or upblast cleaning and both of which have rebound corridors for collecting the abrasive and debris and air wash means for separating the abrasive and returning it to the supply hopper.

Figure 4:
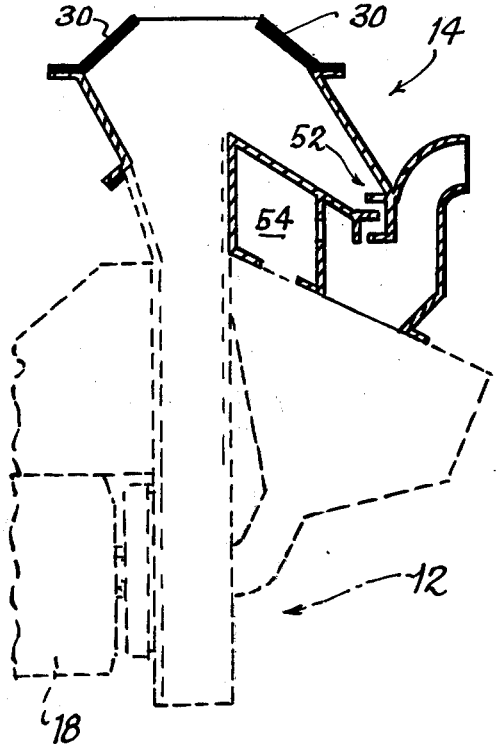
FIG. 4 is a view similar to FIG. 2 again with the blasting head in phantom to highlight the details of the upblast module.

Referring to FIGS. 3 and 4, the structure of the modules can be seen more clearly with the blast head 12 in phantom. Changing from one module to another is easily and quickly effected by merely removing the seal 30 and unbolting one module, replacing it with the desired module and finally replacing the seal. It will be apparent that while side blast and upblast modules have been disclosed, modifications or intermediate modules for special purposes can be designed along the lines suggested by the present invention, the essential element of this invention being the provision of specialized modules on a standard blast head housing to accomplish various cleaning techniques, whereby each of such modules contains the necessary structure for collecting and separating the abrasive to recycle it.

While I have shown and described embodiments of this invention in some detail, it will be understood that this description and accompanying illustrations are offered merely by way of example, and that the invention is to be limited in scope only by the appened claims.

I claim:

1. A blast cleaning device for treating generally vertical and horizontal surfaces, comprising:

a. blasting means for projecting particulate at high velocity;

a. hopper attached to said blasting means supplying particulate thereto; and c. two module means alternately attachable to said blasting means, one of which is always attached to said device, each module means having a different directionally oriented opening therein for defining a blast area for treatment of said vertical and said horizontal surfaces, said module means including:

i. means for recyclying spent particulate to said hopper for reuse, and ii. means for separating the spent particulate from debris generated by said surface treatment prior to returning the particulate to said hopper.

2. The device of claim 1 further including means for effecting a sealing relation between the blast cleaning device and the surface being treated to prevent loss of particulate.

3. The device of claim 1 wherein said blasting means includes:

a. a housing open at one end;

b. at least one means mounted in said housing for projecting particulate toward said open end, said module means being attached to said blasting means at the open end of said housing.

4. The device according to claim 3 wherein said means for projecting includes an airless centrifugal blasting wheel and a motor for driving said wheel.

5. The device according to claim 3 wherein said modules are attached to the open end of said housing by bolting.

6. The device according to claim 1 wherein said recycling means includes:

a. a rebound corridor into which debris and said particulate pass after impacting on said surface, said corridor communicating with said hopper to return said particulate thereto for reuse; and b. means for drawing air across said blast area and into said corridor to enhance passage of said particulate and debris into said corridor, and to prevent heat buildup in said blast area.

7. The device according to claim 1 wherein said separating means includes means for air washing said spent particulate and debris to effect separation thereof.

8. The device according to claim 7 wherein said air wash means includes:

a. means for removing kinetic energy from said particulate and debris to create a free falling curtain of material;

b. an air plenum and inlet in said module on one side of sad curtain permitting entry of air to the module;

c. an exhaust plenum and outlet on the other side of said curtain through which said air is exhausted from said module; and d. means for creating a suction at said outlet whereby a continuous and constant stream of air is caused to enter said inlet, flow across said curtain and out said outlet thereby to effect separation of said debris from said particulate.

9. The device according to claim 8 wherein said means for removing includes a plurality of ledges spatially arranged to form a labyrinth passage for said particulate and debris from said rebound corridor to said air wash means whereby said debris and particulate pass into said air wash means in a state of gravity-free fall.

* * * * *